US010301808B2

(12) United States Patent
Willers

(10) Patent No.: US 10,301,808 B2
(45) Date of Patent: May 28, 2019

(54) BIDET SPRAY

(71) Applicant: CARSTEN WILLERS CONSULTING GMBH, Ahaus (DE)

(72) Inventor: Carsten Willers, Duisburg (DE)

(73) Assignee: Carsten Willers Consulting GmbH, Duisburg (DE)

( * ) Notice: Subject to any disclaimer, the term of this patent is extended or adjusted under 35 U.S.C. 154(b) by 0 days.

(21) Appl. No.: 14/655,775

(22) PCT Filed: Dec. 23, 2013

(86) PCT No.: PCT/EP2013/003914
§ 371 (c)(1),
(2) Date: Aug. 28, 2015

(87) PCT Pub. No.: WO2014/102007
PCT Pub. Date: Jul. 3, 2014

(65) Prior Publication Data

US 2016/0010319 A1 Jan. 14, 2016

(30) Foreign Application Priority Data

Dec. 28, 2012 (DE) ..... 10 2012 025 223

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/420.1–420.4, 444–448; 137/215, 216, 137/216.1
See application file for complete search history.

(56) References Cited

U.S. PATENT DOCUMENTS 3,455,324 A * 7/1969 Bieri ..... E03C 1/102 137/216
3,914,804 A * 10/1975 Schrader ..... A61M 3/0258 4/420.1
3,995,326 A * 12/1976 Umann ..... E03D 9/08 4/420.1
4,062,071 A * 12/1977 Blanquet ..... E03D 9/08 392/492
5,003,645 A * 4/1991 Alonso ..... E03D 9/085 4/420.4

(Continued)

FOREIGN PATENT DOCUMENTS

DE 19 94 14 893 U1 11/1994
DE 9414893 * 11/1994 ..... E03D 9/08

(Continued)

OTHER PUBLICATIONS

International Search Report of International Application No. PCT/EP2013/003914 dated Mar. 27, 2014, 4 pages.

(Continued)

*Primary Examiner* — David P Angwin
*Assistant Examiner* — Nicholas A Ros
(74) *Attorney, Agent, or Firm* — Fay Sharpe LLP

(57) ABSTRACT

A bidet spray includes a fastening device for fastening the bidet spray to an associated water closet (WC) bowl, wherein the fastening device includes two openings. Also provided are a valve and a nozzle, which is connected to the valve by a pipe. The pipe extends forwardly between the two openings.

17 Claims, 4 Drawing Sheets

(56) References Cited

U.S. PATENT DOCUMENTS

| | | | | |
|---|---|---|---|---|
| 5,452,483 | A * | 9/1995 | Dizon, Jr. | E03D 9/08 4/420.4 |
| 6,192,527 | B1 * | 2/2001 | Paul | E03D 9/08 4/420.4 |
| 7,805,778 | B2 * | 10/2010 | Liao | E03D 5/09 4/406 |
| 8,296,872 | B2 * | 10/2012 | Yao | E03D 9/08 4/420.2 |
| 9,874,005 | B2 * | 1/2018 | Krabbe | E03C 1/284 |
| 2004/0068785 | A1 | 4/2004 | Tomita et al. | |
| 2008/0016608 | A1 * | 1/2008 | Lee | E03D 9/08 4/445 |

FOREIGN PATENT DOCUMENTS

| | | |
|---|---|---|
| DE | 20 2006 013 209 U1 | 12/2006 |
| FR | 2 320 076 A1 | 3/1977 |
| GB | 2 269 401 A | 2/1994 |

OTHER PUBLICATIONS

International Preliminary Report on Patentability of International Application No. PCT/EP2013/003914 dated Jun. 30, 2015, 9 pages.

* cited by examiner

BIDET SPRAY

BACKGROUND

The invention relates to a bidet spray, which includes a fastening device with two openings for fastening the bidet spray to a WC bowl, a valve and a nozzle, wherein the nozzle is connected to the valve by a pipe.

The invention is particularly directed to a bidet spray constituting an add-on module for a conventional water closet (WC) which has no bidet spray function.

WCs with a bidet spray are also known as "shower-WCs". Commercially known shower-WCs have an integrated shower function for the anal and/or genital region of the user. For this purpose, arranged at the end of the shower device there is a nozzle, through which the water discharges in the direction towards the area to be cleaned. The nozzle is generally extendible, that is to say either electromechanically or under water pressure. In the latter case, the water pressure is used for supplying the nozzle.

The shower device is controlled by means of the valve, by means of which the water supply is opened and closed. The actuation can be effected, for instance, manually, that is to say by opening the valve, or electromechanically, whereby in the case of electromechanical control a pulse is triggered, which effects opening or closing of the valve. The flow volume can additionally frequently be regulated.

Shower-WCs with an integral bidet spray are sophisticated WCs which, depending on their configuration, have other functions, such as a drying function, heating function of the WC seat and the like. Such shower-WCs have basically proved to be satisfactory. Their complexity makes them, however, very expensive. A move has therefore been made to offer shower devices as a retrofit component for conventional WCs as an alternative to shower WCs with an integral shower device. The invention is directed particularly to such shower devices.

A shower device is known in practice, which can be retrofitted as an add-on module to a conventional WC. The known shower device includes a fastening device with two openings. The threaded rods of the WC seat hinge for fastening the WC seat to the WC bowl pass through the two openings. For the purpose of fastening, the shower device is thus clamped between the WC seat and the bowl.

The known shower device permits the economical conversion of conventional WCs. Merely a separate water connection is necessary for the bidet spray function.

The known shower device is quite high structurally. This has the result that the WC seat also rises in its rear section so that there is the risk that the rear section of the WC seat no longer rests on the WC bowl. In addition to optical penalties, there can be the risk of overloading of the WC seat and/or shower device.

This is where the invention steps in.

It is the object of the invention to provide a retrofittable shower device, which ensures a flat, stable and durable overall arrangement.

BRIEF SUMMARY

In order to solve this object, the bidet spray of the type referred to above is characterised in accordance with the invention in that the pipe extends forwardly between the two openings.

The invention is based on the fundamental concept that a particularly flat construction can be created preferably by the fact that the pipe extends at least partially behind the openings in the fastening device. Only the feed pipe to the nozzle, which for its part is preferably arranged in front of the fastening device, extends forwardly between the openings. This pipe section can be maintained flat from the technical point of view, particularly if the pipe is of hose type, as is considered to be preferred.

The fastening of the bidet spray to the WC bowl assumes a particular significance. It must, on the one hand, be of flat construction and, on the other hand, of robust construction. A particularly advantageous construction is characterised in that the fastening device includes at least one and preferably two fastening lug(s). The at least one fastening lug offers the possibility of being clamped between the hinge (for fastening the WC seat to the bowl) and the bowl. To this end, hinge pegs of hinges extend through respective openings, which can be open or closed and are particularly constructed in the form of elongate holes.

Two fastening lugs offer the advantage of a weight saving. In particular, the fastening lugs can be so constructed that their spacing from one another may be altered. This ensures the ability of adapting to different fastenings of WC seats and/or WC bowls. At their rear end, the fastening lug(s) can conveniently be connected to a housing of the shower device, as will be explained in more detail below.

A number of materials, including plastic, are basically possible for the fastening device. A fastening device of metal has proved to be particularly satisfactory. It fulfils the requirement for stability to a particular extent with a minimal space requirement at the same time. The fastening device preferably includes two separate fastening lugs, which advantageously afford respective openings. The advantage of an independent arrangement of the fastening lugs lies, in addition to the advantage of adaptability outlined above, in the fact that sufficient space remains between the fastening lugs in order to be able to position the pipe extending forwardly between the two openings.

The fastening device advantageously has a height of at most 10 mm, particularly of at most 3 mm, at least in the vicinity of the openings.

If the fastening device is made of metal, sufficient stability is provided if the fastening device is constructed significantly thinner than 10 mm, particularly thinner than 3 mm, for instance ca. 1 mm.

The bidet spray preferably has a housing with preferably an underside and an upper side. The pipe is advantageously positioned in the housing. The housing protects the components accommodated in the housing and permits them to be inspected, if the upper side and the under side are releasably connected together, as is considered to be advantageous.

The fastening lugs conveniently extend from the housing, advantageously forwardly. The housing is thus preferably arranged behind the fastening lugs (or generally the fastening device). This means that the housing can be arranged behind the WC seat in the installed state, which does not exclude the possibility that it also extends forwardly laterally of the WC seat, as will be explained in more detail below.

A particularly advantageous embodiment of the invention is characterised in that the fastening device is fitted into the housing, particularly in the underside and is preferably movable relative to the housing. As a result of the (lateral) movement of the fastening device, the bidet spray can be adapted to different (predetermined) openings in the WC bowl for the WC seat fastenings. For this purpose, the underside preferably has a series of notches, which cooperates with the fastening device. The series of notches further prevents lateral slipping of the installed bidet spray.

The fastening device is advantageously clamped between the upper side and the underside of the housing. Such a construction permits a simple fixing of the fastening device to the housing and further ensures simple adjustability.

In some countries, safety valves must be installed at those water removal positions which are at risk. A bidet spray is one of the positions at risk. The safety valves ensure that the removal positions at risk are protected from the sucking back, pressing back or flowing back of non-potable water.

It is proposed in an embodiment of the invention that a water safety device is arranged in the housing of the bidet spray. The water safety device can be, in particular, a free outlet with an injector. A water jet is sprayed across a free space into a receptacle, which can be of funnel-like construction. In the event of backflow or the like of water, the (potentially contaminated) water cannot flow back via the injector into the drinking water pipe by reason of the free space. It is possible to maintain a necessary minimum pressure by means of the injector, which is required in order to move or extend the nozzle against a restoring force out of its rest position into the working position.

With a free outlet with an injector, there is, for example, leakage as a result of sprayed water, which must be discharged. It is proposed in this connection that the underside of the housing defines a channel for the leakage. The underside thus assumes two duties, namely, on the one hand, the fastening of the water safety device and, on the other hand, the discharge of the leakage into the WC. It can be provided additionally or alternatively that the supply pipe for the nozzle is arranged in the channel.

In a particularly advantageous embodiment, the water safety device is arranged behind the openings and the underside extends forwardly between the two openings. Since the water safety device has a certain height, determined by its structure, it is arranged in the advantageous embodiment behind the openings, which has the result that it is located behind a WC seat, in the installed state. The channel, on the other hand, can be maintained flat and positioned extending forwardly between the openings. As a result of this feature no increase in height is advantageously necessary of the (existing) WC seat.

A particularly advantageous construction is characterised in that the nozzle is arranged at a free end of the underside of the housing. The nozzle can, in particular, be fastened to the underside. It is considered to be particularly advantageous if the nozzle is extendible under the action of the water pressure, preferably downwardly (in the installed state), particularly substantially vertically downwardly. The nozzle itself has a spray angle, which is directed upwardly.

The upper side of the housing preferably covers the channel. It can furthermore be provided that the upper side also covers the nozzle. For this purpose, the upper side conveniently affords a downwardly directed cover in its end region. If necessary, the nozzle moves out downwardly beyond the cover.

The invention is directed further to a WC with a bidet spray. The WC preferably has a WC seat, the fastening of which to the WC bowl also provides the fastening of the bidet spray. In particular, the fastening device is advantageously fixed in position on the WC bowl with the fastening with which a WC seat is fixed in position on the WC bowl. The fastening can be e.g. two hinges or hinge pegs. A central idea of the invention is that the bidet spray for its part does not constitute a hinge for the WC seat.

The invention will be explained below in more detail by way of a preferred exemplary embodiment in conjunction with the attached drawings, in which:

DETAILED DESCRIPTION

Figure 1:
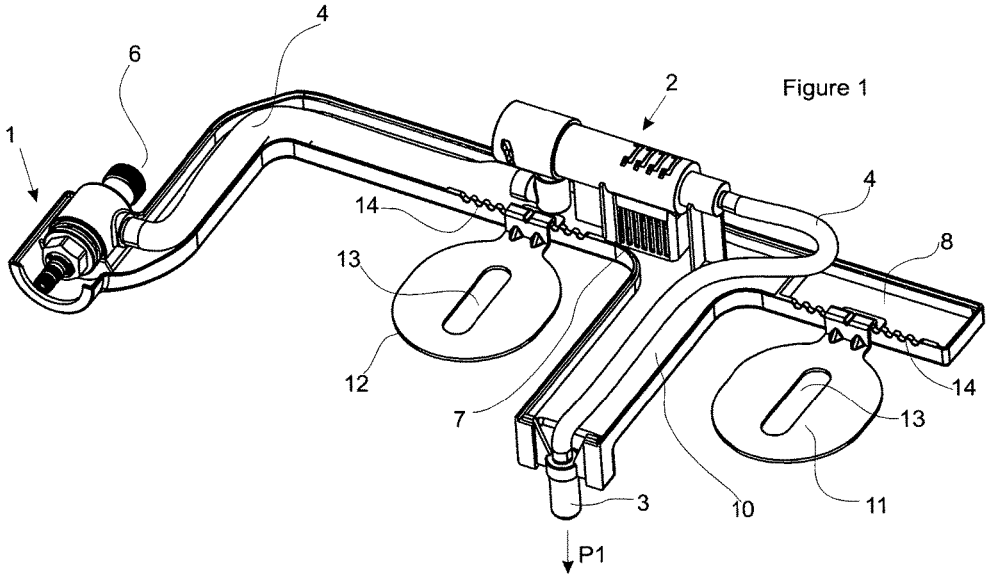
FIG. 1 shows an exemplary embodiment of a shower device in accordance with the invention without the upper side of the housing.

FIG. 1 is a perspective view of a shower device in accordance with the invention. The shower device consists of three important components, namely a valve 1, a water safety device 2 and a nozzle 3. The valve 1 and the water safety device 2 are connected together by means of a pipe 4. The same applies to the water safety device 2 and the nozzle 3.

The valve 1 is operable by means of a rotary knob 5 (see FIG. 2) and connected by a rear connection 6 to a water pipe, which is not shown. If the user turns the valve 1 on, water flows through the pipe section 4, the water safety device 2 and the subsequent pipe section 4 and discharges out of the nozzle 3. The nozzle 3 is so constructed that it moves out against a restoring force, that is to say in the direction of the arrow P1 vertically downwardly. The water flows through the nozzle 3 into the region of the user which is to be cleaned.

The water safety device 2 is preferably a water safety device in accordance with DIN EN1717, which, in particular, has a free outlet with an injector. Any leakage is discharged to the exterior through openings 7 in the water safety device 2.

Figure 2:
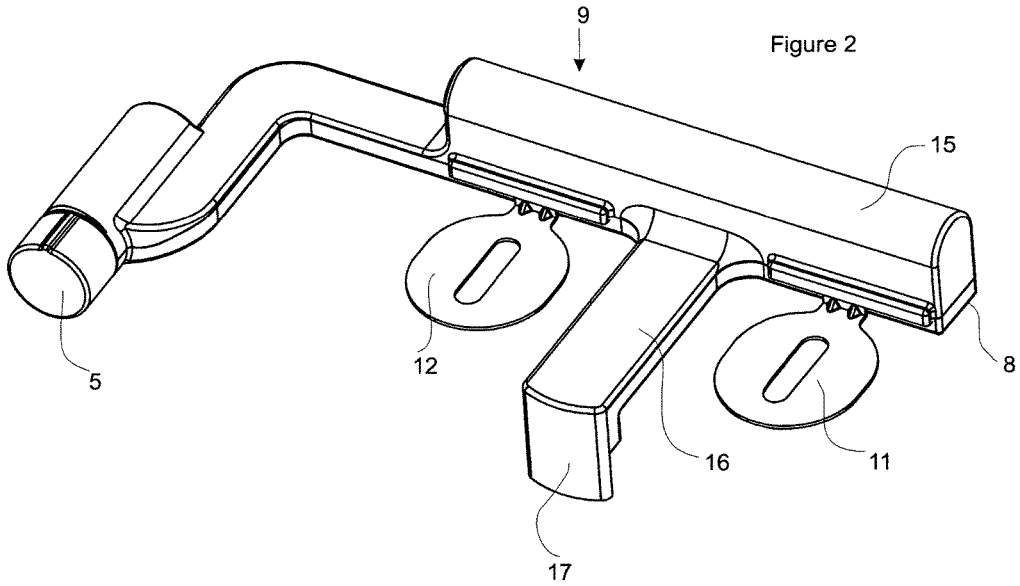
FIG. 2 shows the shower device with the housing closed.

The valve 1, the water safety device 2 and the nozzle 3 are preferably fixed to a lower portion 8 of a housing 9 (see FIG. 2). The lower portion 8 defines a channel 10, via which the leakage can run off into a WC bowl. The channel 10 serves at the same time to receive the pipe 4.

The bidet spray is fixed to the WC bowl by means of a fastening device, which, in the illustrated preferred embodiment, consists of two lugs 11, 12, which are preferably made of metal, which permits a particularly flat and nevertheless stable and durable construction. The lugs 11, 12 have a respective hole 13, which is preferably constructed in the form of an elongate hole and through each of which a respective hinge of the WC seat engages, as will be described in more detail in connection with FIG. 4. As an alternative to the two fastening lugs, a one-piece fastening device can be provided.

The fastening lugs 11, 12 are preferably movable independently of one another relative to the housing for their adjustment and advantageously fixed in the underside 8 of the housing 9. The underside 8 includes a series of notches 14 which cooperates with the respective lug 11, 12. The series of notches 14 offers additional support for the lugs 11, 12 and prevents the shower device inadvertently shifting laterally.

FIG. 2 shows the bidet spray with the housing 9 closed. For this purpose, an upper side 15 is clipped, secured by adhesive or screwed to the underside 8 of the housing. As a result of the housing, the bidet spray is protected from dust and is simple to clean.

The housing 9 defines with its upper side 15 an arm 16, which extends forwardly between the lugs 11, 12 and defines, preferably in its end region, a downwardly extending cover 17. The cover 17 protects the nozzle 3 in its rest position from contamination. Only when the actuating knob 5 is actuated, does the nozzle 3 move downwardly under water pressure from its rest position into the working position so that it projects beneath the cover and can freely discharge the water jet.

Figure 3:
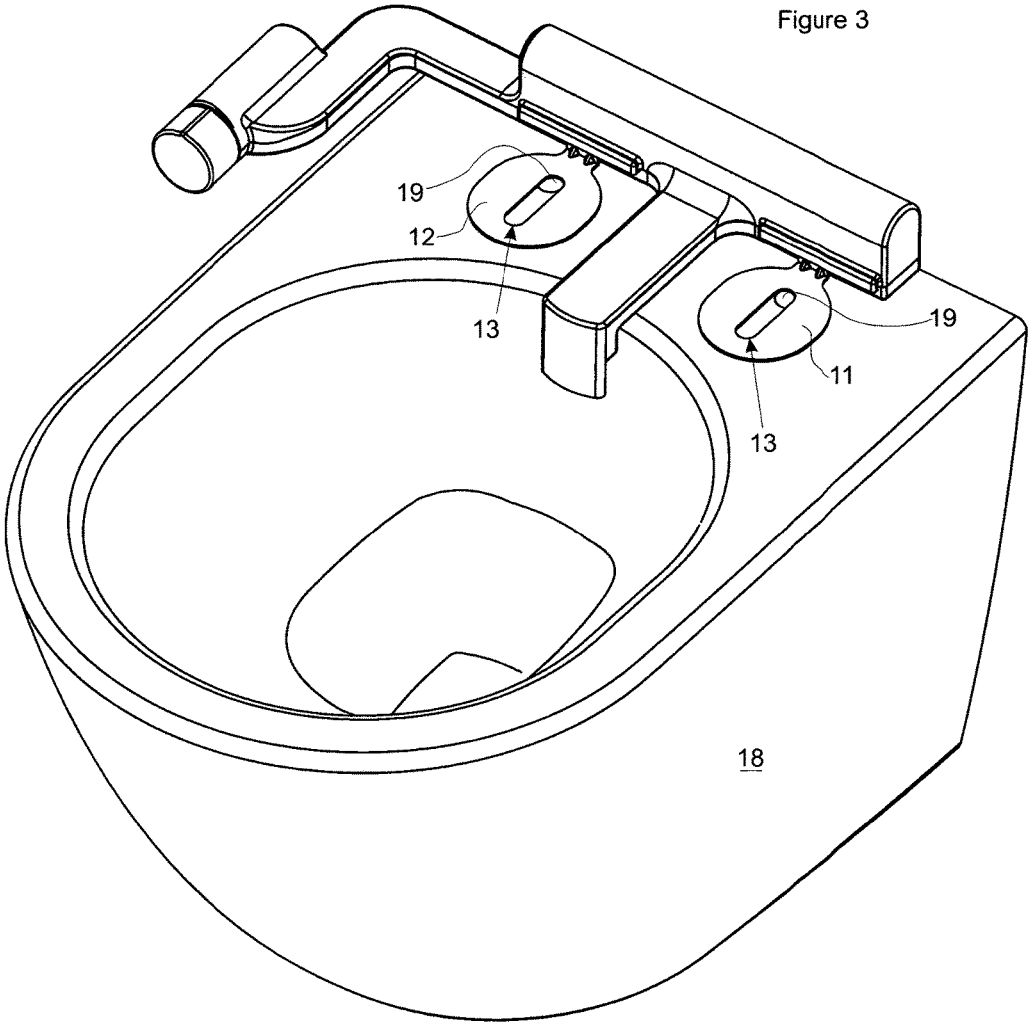
FIG. 3 shows the shower device in conjunction with a WC bowl.

FIG. 3 shows the bidet spray on a WC bowl 18. The WC bowl 18 has two openings 19, through which two hinges 20 (shown in FIG. 4) extend. Reference is made in this connection to the fact that hinges can nowadays be of multi-part construction. For instance, they can include a hinge pin and a hinge fixture releasably connected to it. Such multi-part hinges are intended to be embraced by the term hinge. The bidet spray may be adapted to the shape of the WC bowl 18 and/or of the WC seat by means of the longitudinal hole 13.

Figure 4:
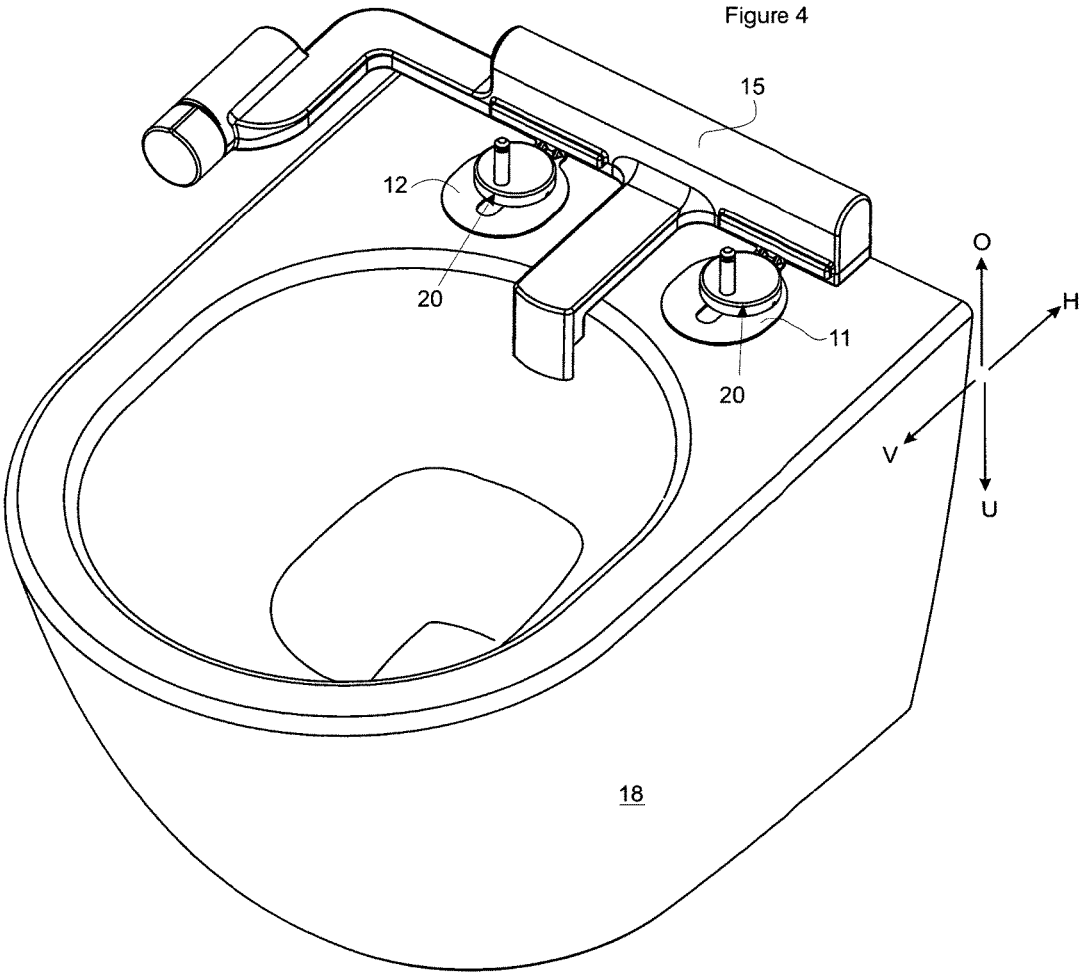
FIG. 4 shows the shower device in a manner analogous to FIG. 3 but with two hinges of the WC seat.

Reference is made to FIG. 4, from which it will be apparent that the lugs 11, 12 are clamped between the WC bowl and the hinges 20. Incidentally, it is made clear once more with the aid of the coordinate system what is to be understood by the positional information top, bottom, front and rear (or back). These are consistent with the usual terminology relating to a WC. This applies also to the references to the shower device. It will be clear from FIG. 4 that the pipe 4 (in this case covered by the upper side 15 of the housing) extends in the plan view behind the hinges 20 and extends forwardly between the hinges 20.

Figure 5:
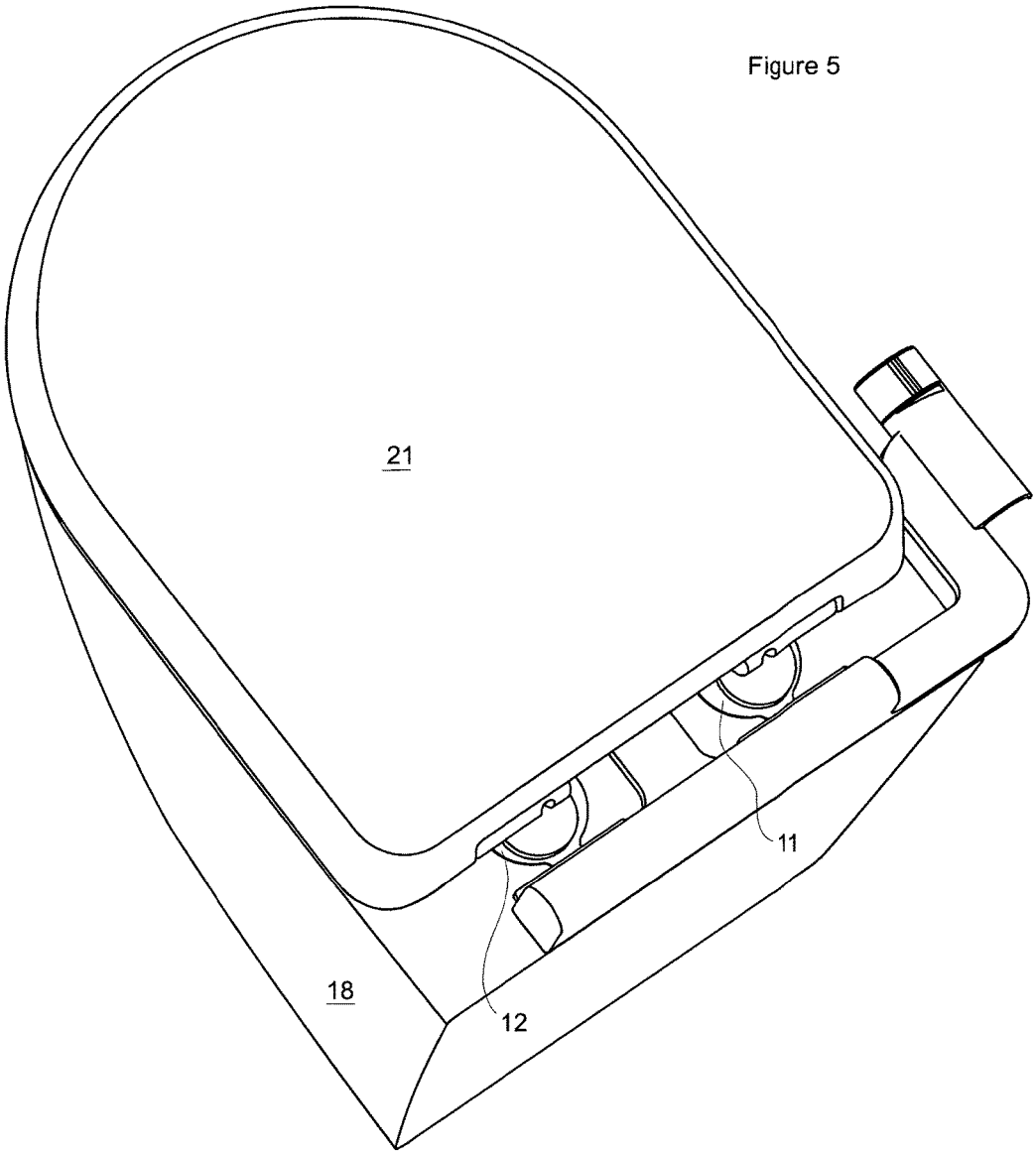
FIG. 5 shows the shower device with a WC bowl and WC seat.

FIG. 5 shows a WC with a WC seat 21 equipped with a bidet spray in accordance with the invention. As a result of the bidet spray in accordance with the invention, no significant increase in height of the WC seat 21 advantageously occurs. This is achieved as a result of the fact that only the thin fastening lugs 11, 12, preferably of metal, are clamped between the WC seat 21 and the WC bowl 18. The higher components, such as the water safety device 2, are arranged behind the WC seat 21.

LIST OF REFERENCE NUMERALS

1 Valve
2 Water safety device
3 Nozzle
4 Pipe
5 Rotary knob
6 Connection
7 Openings
8 Lower portion
9 Housing
10 Channel
11 Lug
12 Lug
13 Hole
14 Series of notches
15 Upper side
16 Arm
17 Cover
18 WC bowl
19 Openings
20 Hinge
21 WC seat
O Top
U Bottom
V Front
H Rear

The invention claimed is:

1. A bidet spray, comprising:
a housing;
a water safety device supported by the housing, wherein the water safety device includes leakage openings;
a channel defined by the housing and extending forwardly of the water safety device;
a nozzle disposed at an outlet of the channel;
a pipe communicating the water safety device with the nozzle;
wherein the nozzle is narrower in diameter than is a width of the outlet of the channel in order to allow leakage from the leakage openings of the water safety device to flow past the nozzle and out of the channel; and,
wherein the housing includes an upper portion and a lower portion which are releasably connected together.

2. The bidet spray of claim 1 wherein at least a portion of the pipe extends in the channel.

3. The bidet spray of claim 1 wherein the leakage openings are disposed adjacent an inlet of the channel.

4. The bidet spray of claim 1 further comprising a fastening device mounted to the housing.

5. The bidet spray of claim 4 wherein the fastening device includes a pair of spaced fastening lugs, one positioned on either side of the channel.

6. The bidet spray of claim 4 wherein the fastening device is adjustable in relation to the housing.

7. A bidet spray including
a fastening device for fastening the bidet spray to an associated water closet (WC) bowl, wherein the fastening device includes two openings,
a valve,
a nozzle, and
a water safety device,
wherein the valve and the water safety device are connected together by means of a first pipe,
wherein the water safety device and the nozzle are connected together by means of a second pipe such that a proximal end of the second pipe is connected to the water safety device and a distal end of the second pipe is connected to the nozzle,
wherein the second pipe extends forwardly between the two openings,
wherein the bidet spray includes a housing with an underside and an upper side,
wherein the underside defines a channel to accommodate leakage from the water safety device, wherein the channel is covered by the upper side,
wherein the channel at the same time receives the second pipe such that the nozzle is located at a free end of the channel in such a manner that leakage from the water safety device is allowed to flow past the nozzle and out of the channel, and
wherein the underside extends forwardly between the two openings.

8. A bidet spray as claimed in claim 7, wherein the fastening device is made of metal.

9. A bidet spray as claimed in claim 7, wherein the fastening device is connected to the underside of the housing and is movable relative to the housing.

10. A bidet spray as claimed in claim 7, wherein the fastening device includes at least one fastening lug.

11. A bidet spray as claimed in claim 10, wherein the at least one fastening lug extends from the housing.

12. A bidet spray as claimed in claim 7, wherein the fastening device has a height of at most 10 mm in the vicinity of the openings.

13. A bidet spray as claimed in claim 12, wherein the fastening device has a height of at most 3 mm in the vicinity of the openings.

14. A water closet (WC) with a bidet spray as claimed in claim 7.

15. A WC as claimed in claim 14, wherein fastening device is fixed to a bowl of the WC with a fastening member with which a WC seat is also fixed to the WC bowl.

16. A WC as claimed in claim 15, wherein the height of the bidet spray on the rear side of the WC seat projects at most 20 mm above the WC seat.

17. A WC as claimed in claim 16, wherein the height of the bidet spray on the rear side of the WC seat is less than a height of the WC seat.

* * * * *